US009108080B2

(12) United States Patent
Cataldi et al.

(10) Patent No.: US 9,108,080 B2
(45) Date of Patent: Aug. 18, 2015

(54) ORTHOSIS MACHINE

(75) Inventors: Theodore F. Cataldi, McKees Rocks, PA (US); Brian F. Hagen, Wexford, PA (US)

(73) Assignee: For You, Inc., McKees Rocks, PA (US)

( * ) Notice: Subject to any disclaimer, the term of this patent is extended or adjusted under 35 U.S.C. 154(b) by 953 days.

(21) Appl. No.: 13/045,890

(22) Filed: Mar. 11, 2011

(65) Prior Publication Data

US 2012/0232438 A1 Sep. 13, 2012

(51) Int. Cl.

| | |
|---|---|
| ***A61H 1/00*** | (2006.01) |
| ***A61H 1/02*** | (2006.01) |
| ***A63B 21/00*** | (2006.01) |
| ***A63B 21/005*** | (2006.01) |
| ***A63B 23/035*** | (2006.01) |
| ***A63B 23/04*** | (2006.01) |

(Continued)

(52) U.S. Cl.

CPC ..... *A63B 21/1488* (2013.01); *A61H 1/0259* (2013.01); *A63B 21/0058* (2013.01); *A63B 21/00178* (2013.01); *A63B 21/143* (2013.01); *A63B 23/03508* (2013.01); *A63B 23/0405* (2013.01); *A63B 23/0494* (2013.01); *A61H 2201/0173* (2013.01); *A61H 2201/0188* (2013.01); *A61H 2201/1642* (2013.01); *A61H 2201/1664* (2013.01); *A61H 2201/5007* (2013.01); *A61H 2201/5048* (2013.01); *A61H 2201/5066* (2013.01); *A61H 2201/5097* (2013.01); *A61H 2203/0425* (2013.01); *A61H 2203/0456* (2013.01); *A63B 2071/0072* (2013.01); *A63B 2071/0081* (2013.01); *A63B 2071/0625* (2013.01); *A63B 2071/0655* (2013.01); *A63B 2071/0683* (2013.01); *A63B 2208/0238* (2013.01); *A63B 2208/0252* (2013.01); *A63B 2209/10* (2013.01); *A63B 2220/803* (2013.01); *A63B 2220/89* (2013.01); *A63B 2225/54* (2013.01)

(58) Field of Classification Search

CPC ..... A61H 1/00; A61H 1/02; A61H 1/0237; A61H 1/0255; A61H 1/0259; A61H 1/0266; A61H 2001/00; A61H 2001/02; A61H 2001/0203; A61H 2001/0237; A61H 2001/0266; A61H 2201/5064; A61H 2201/5066; A61H 2203/045

USPC ..... 601/5, 23, 27, 29, 31–35; 482/92–93, 482/131–133

See application file for complete search history.

(56) References Cited

U.S. PATENT DOCUMENTS

| | | | | |
|---|---|---|---|---|
| 3,877,422 | A * | 4/1975 | Heuser et al. | 601/116 |
| 4,186,920 | A * | 2/1980 | Fiore et al. | 482/79 |
| 4,199,137 | A * | 4/1980 | Giguere | 482/79 |

(Continued)

FOREIGN PATENT DOCUMENTS

DE 102008023573 A1 11/2009

*Primary Examiner* — Justine Yu
*Assistant Examiner* — Christopher Miller
(74) *Attorney, Agent, or Firm* — The Webb Law Firm

(57) ABSTRACT

An orthosis machine for providing therapeutic and/or rehabilitative functionalities including at least one of Continuous Passive Motion, Passive Range of Motion, Active Assistive Range of Motion, Active Range of Motion, Resistive Range of Motion, proprioception training and biofeedback from a seated, supine, or recumbent position. Therapeutic and/or rehabilitative functionalities provided by the orthosis machine may be powered by the user or a motor and may be used through one or more phases of post surgical and/or general rehabilitation and physical therapy from multiple angular positions.

20 Claims, 15 Drawing Sheets

(51) Int. Cl.
*A63B 71/00* (2006.01)
*A63B 71/06* (2006.01)

(56) References Cited

U.S. PATENT DOCUMENTS

| | | | | | |
|---|---|---|---|---|---|
| 4,229,001 | A | * | 10/1980 | Roman | 482/79 |
| 4,509,509 | A | * | 4/1985 | Bouvet et al. | 601/15 |
| 4,549,534 | A | * | 10/1985 | Zagorski et al. | 601/34 |
| 4,558,692 | A | * | 12/1985 | Greiner | 601/33 |
| 4,621,620 | A | * | 11/1986 | Anderson | 601/34 |
| 4,637,379 | A | * | 1/1987 | Saringer | 601/34 |
| 4,665,899 | A | * | 5/1987 | Farris et al. | 601/33 |
| 4,751,917 | A | * | 6/1988 | Ruf | 601/34 |
| 4,834,073 | A | | 5/1989 | Bledsoe et al. | |
| 4,974,830 | A | * | 12/1990 | Genovese et al. | 601/29 |
| 5,020,518 | A | * | 6/1991 | Spears et al. | 601/116 |
| 5,088,475 | A | * | 2/1992 | Steffensmeier | 601/116 |
| 5,228,432 | A | | 7/1993 | Kaiser et al. | |
| 5,239,987 | A | * | 8/1993 | Kaiser et al. | 601/34 |
| 5,280,783 | A | * | 1/1994 | Focht et al. | 601/34 |
| 5,303,716 | A | | 4/1994 | Mason et al. | |
| 5,399,147 | A | * | 3/1995 | Kaiser | 601/34 |
| 5,509,894 | A | | 4/1996 | Mason et al. | |
| 5,860,898 | A | * | 1/1999 | Ellis | 482/130 |
| 6,117,056 | A | * | 9/2000 | Cataldi et al. | 482/121 |
| D437,014 | S | | 1/2001 | Blanchard et al. | |
| 6,217,532 | B1 | | 4/2001 | Blanchard et al. | |
| 6,221,032 | B1 | | 4/2001 | Blanchard et al. | |
| 6,221,033 | B1 | | 4/2001 | Blanchard et al. | |
| 6,224,521 | B1 | | 5/2001 | Foucault | |
| 6,267,735 | B1 | | 7/2001 | Blanchard et al. | |
| 6,325,770 | B1 | | 12/2001 | Beny et al. | |
| 6,595,904 | B1 | | 7/2003 | Staffa | |
| 6,599,255 | B2 | * | 7/2003 | Zhang | 600/587 |
| 7,204,814 | B2 | | 4/2007 | Peles | |
| 8,083,694 | B2 | | 12/2011 | Peles | |
| 2006/0064044 | A1 | * | 3/2006 | Schmehl | 601/34 |
| 2006/0211957 | A1 | | 9/2006 | Beny et al. | |
| 2008/0242519 | A1 | * | 10/2008 | Parmater | 482/72 |
| 2009/0204033 | A1 | * | 8/2009 | Shelbourne et al. | 601/5 |
| 2009/0306553 | A1 | * | 12/2009 | Mulholland et al. | 601/5 |
| 2011/0040215 | A1 | * | 2/2011 | Knoll | 601/34 |
| 2011/0208098 | A1 | * | 8/2011 | Zaborowski | 601/33 |

* cited by examiner

ORTHOSIS MACHINE

BACKGROUND AND SUMMARY

The present invention relates to apparatus and methods for an orthosis machine, and more particularly, to an orthosis machine which may be used to provide continuous passive motion (CPM) and/or other therapeutic and/or rehabilitative functionalities to a user.

It is often beneficial, following operations that involve treatment of a patient's joints, to use a continuous passive motion machine (CPM) to apply passive movement to the affected joint or joints and associated muscles, to avoid various postoperative problems that may occur if the joint is immobilized. Continuous passive motion devices (CPM's) are generally motor-driven and exercise an affected joint by repeatedly flexing and extending the limb portions on either side of the joint. Often, the CPM will support one or more limb portions as it flexes and extends the affected joint. Conventional CPM's for use on a patient's knee can be found in the literature, for example U.S. Pat. No. 6,221,033 to Blanchard et al., which discloses a continuous passive motion device for providing physical therapy for a knee of a patient.

Conventional CPM's are largely designed for one purpose; to provide passive motion via a drive motor to move the joint through its range of motion and in order to restore or maintain range of motion when the patient is unable to adequately do so independently of their own volition, and are generally limited to passive motion in one plane only, as one phase of the rehabilitation process. However, these conventional CPM's generally lack options for progressive rehabilitation during the full range of the healing process.

In general, a rehabilitation process following hip or knee surgery includes four phases: passive range of motion, active assistive range of motion (AAROM), active range of motion (AROM), and resisted range of motion (RROM). Passive range of motion is performed with essentially little to no effort by the user; the primary forces involved are provided by the machine. Active assistive range of motion (AAROM) is generally performed when the user actively tries to move a joint through muscle contraction but is assisted by some outside force such as a machine, another person, or another part of the patient's body such as, for example, an arm. Active Range of Motion (AROM) may be performed when the user actively moves a joint through the range of motion by their own efforts through muscle contraction. Resisted range of motion/strengthening phase of motion (RROM) may be performed when the user actively moves a joint against a resistance placed against the joint during motion via some resistance device such as an elastic band or weight.

It is also useful for the patient to make use of proprioception, the body's ability to detect motion and spatial awareness, during the healing and/or therapy process. This is especially important due to proprioception often being used by the body for protection of a joint or to guide fine motor movements. Accordingly, proprioception training is important because the human body's motion detection system is employed during proprioception (i.e. the body's ability to determine motion in space and sense movement and joint position). Patients that have undergone injury or surgical intervention often have damaged proprioceptive abilities and/or have lost acuity in a joint because soft tissue and/or joint structures have been damaged.

Conventional CPMs that provide passive joint motion are generally useful only for the passive range of motion phase, and generally do not provide any option for additional rehabilitation phases including AAROM, AROM, or RROM/ strengthening on multiple levels. Likewise, conventional CPM's generally do not provide proprioception training or biofeedback, or provide passive knee extension to restore full motion to a stiff knee.

Additionally, conventional CPM devices generally need to be used on a flat surface and generally require the user to be in a supine or recumbent position as is common in the art. These positions often become very uncomfortable and/or create other physical problems for patients. Accordingly, it would be useful and beneficial to provide a CPM that could operate during multiple phases of recuperation, healing, and/or therapy processes, and allow the patient to use the device while in different positions including being comfortably seated on a chair or bed.

Accordingly, one aspect of the present invention is directed to an orthosis machine for facilitating motion of a user which may comprise a base with a track mounted thereto and a carriage slidably mounted to the track. A cradle may be adapted to hold a portion of a bodily appendage of the user and a rotational joint may be configured to connect the cradle to the carriage, wherein the rotational joint may be adjustable into a first configuration in which the cradle is firstly secured to the carriage preventing rotation of the cradle in at least one plane, and a second configuration in which the cradle may be secondly secured to the carriage allowing rotation of the cradle in more than one plane.

Another aspect of the present invention is directed to an orthosis machine for facilitating motion of a user which may comprise a base with a track mounted thereto and a carriage slidably mounted to the track. A cradle may be adapted to hold a portion of a bodily appendage of the user and may be detachably connectable to a drive train. The drive train may be operable by a motor such that the drive train moves the carriage along the track when the drive train is connected to the carriage and the motor is operating. At least one stop may be slidably connected to the track, at least one stop detector may be mounted to the carriage, and electronic circuitry may be configured to reverse the direction when at least one stop detector comes into proximity of at least one stop. An indicator may also be operable to alert the user when the carriage is near at least one stop.

Additionally, one aspect of the present invention is directed to an orthosis machine for facilitating motion of a user which may comprise a base and a track mounted to the base with a carriage slidably mounted to the track. A cradle may be adapted to hold a portion of a bodily appendage of the user. At least one stop may be slidably connected to the track, at least one stop detector may be mounted to the carriage and an indicator may be operable to alert the user when the carriage is near at least one stop.

Another aspect of the present invention is directed to an orthosis machine for facilitating motion of a user which may include a base having an upper baseplate rotatably connected to the base and a track mounted to the base. A carriage may be slidably mounted to the track and a cradle may be adapted to hold a portion of a bodily appendage of the user. A drive train may also be detachably connectable to the carriage and operable by a motor such that the drive train moves the carriage along the track when the drive train is connected to the carriage and the motor is operating.

Additionally, one aspect of the invention is directed to an orthosis machine for facilitating motion of a user comprising a base having at least one attachment portion mounted thereto and a track mounted to the base. A carriage may be slidably mounted to the track and the carriage may have at least one attachment portion mounted thereto. A cradle may be adapted to hold a portion of a bodily appendage of the user and at least one strap may be secured to at least one attachment portion.

Another aspect of the present invention includes a method of facilitating motion in a seated position on an orthosis machine. The method includes resting on an upper baseplate in a seated position, placing a lower extremity into a cradle positioned below the upper baseplate, and moving the cradle such that the lower extremity changes orientation.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended to unduly limit the present invention. As used in the specification and the claims, the singular form of "a", "an", and "the" include plural referents unless the context clearly dictates otherwise.

DETAILED DESCRIPTION

Figure 1:
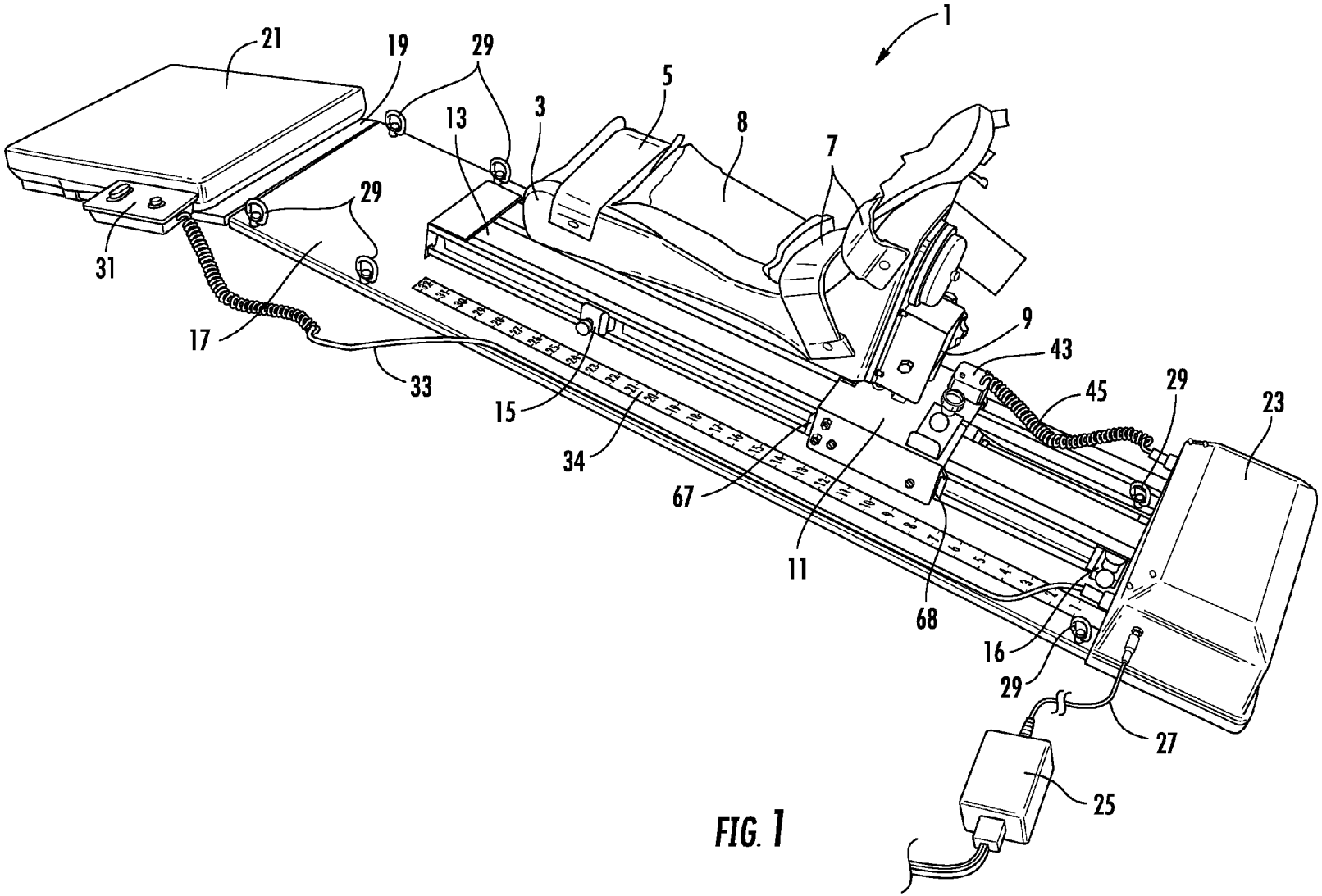
FIG. 1 is a perspective view of an orthosis machine according to an exemplary embodiment of the invention.

The following detailed description is of the best currently contemplated modes of carrying out exemplary embodiments of the invention. The description is not to be taken in an unduly limiting sense, but is made merely for the purpose of illustrating the general principles of the invention, since the scope of the invention is defined by the appended claims.

Various inventive features are described below that may each be used independently of one another or in combination with other features. It should be understood that the invention may assume various alternative variations and/or sequences, except where expressly specified to the contrary. It should be understood that the term "orthosis machine" when referring to embodiments of the claimed invention refers to a device that can be used generally as an CPM machine but that also may have enhanced functions including other modes of rehabilitation/exercise as described further herein.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as unduly limiting.

With reference to FIGS. 1-8, an exemplary embodiment of a knee and hip orthosis machine 1 includes a lower appendage cradle 3 that may be furnished with a shin strap 5, foot straps 7, and/or a supportive cushion 8. The lower appendage cradle 3 may be connected via a rotational joint 9 to a carriage 11. The carriage 11 may be slidably mounted to a track 13. Upper stops 15 and lower stops 16 may be slidably mounted to either side of the track 13. The track 13 may further be mounted to a base 17. The base 17 may be rotatingly or hingedly connected to an upper baseplate 19, for example by a hinge 20 which may be located beneath the base 17 the upper baseplate 19. Friction portions 18 may also be positioned beneath base 17 and/or upper baseplate 19 to prevent slippage of the orthosis machine 1 and/or provide an attachment area for materials requiring frictional engagement such as Velcro®, for example. A seat pad 21 may be releasably mounted to the upper baseplate 19 via attachment extensions 22. A motor compartment 23 may be mounted to the base 17 and connected to a power supply 25 via a power cord 27. Multiple attachments 29 may be mounted to the base 17. A remote control unit 31 may be connected to circuitry in the motor compartment 23 via a control cord 33. A positioning gauge 34 may be mounted on the base 17 running alongside the track 13.

Figure 3:
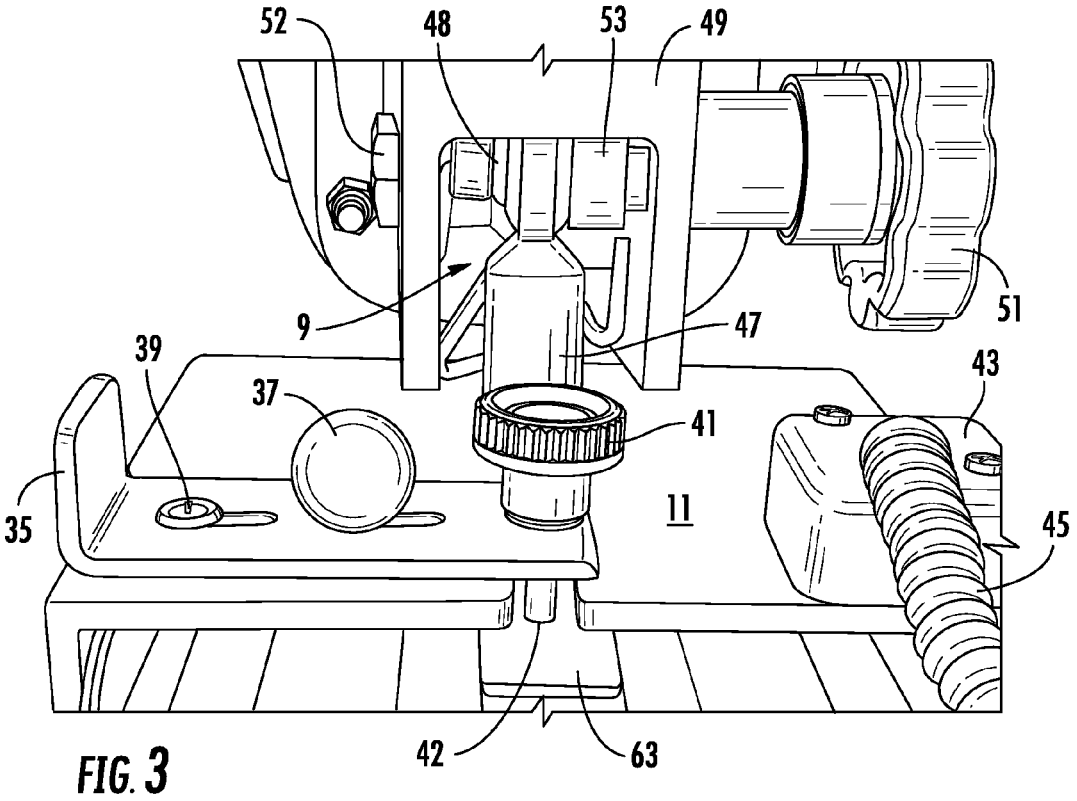
FIG. 3 is a partial perspective view of an orthosis machine according to an exemplary embodiment of the invention, including the area of the proprioception joint.

With reference to FIG. 3, an engaging plate 35 may be slidably attached to the carriage 11, held in place by a slide screw 37 and a securing screw 39 and configured to slidably engage an engaging knob 41. The engaging plate 35 is shown as a linearly slidable mechanism, although other engagement mechanisms may be used such as, for example, a gate latch or other device such that carriage 11 may engage and disengage the belt 64. Engaging knob 41 may further be adjustably engaged to a drive anchor 63 via attachment aperture 42. A communication port 43 may be secured to the carriage 11 providing a connection for a communication cord 45, preferably, but not necessarily, a coiled cord that may communicatively connect the communication port 43 with the circuitry in the motor compartment 23, as may be seen in FIG. 10. A joint 47 may be mounted to the carriage 11 which may include a socket portion that surrounds at least a portion of ball 48 near the center of the rotational joint 9 within a joint housing 49. A tightening knob 51 may be mounted to one end of a shaft or bolt 52 that may extend through the joint housing 49 to assist in tightening and/or loosening a bushing 53 operable to secure and/or loosen the rotational joint 9.

Figure 4:
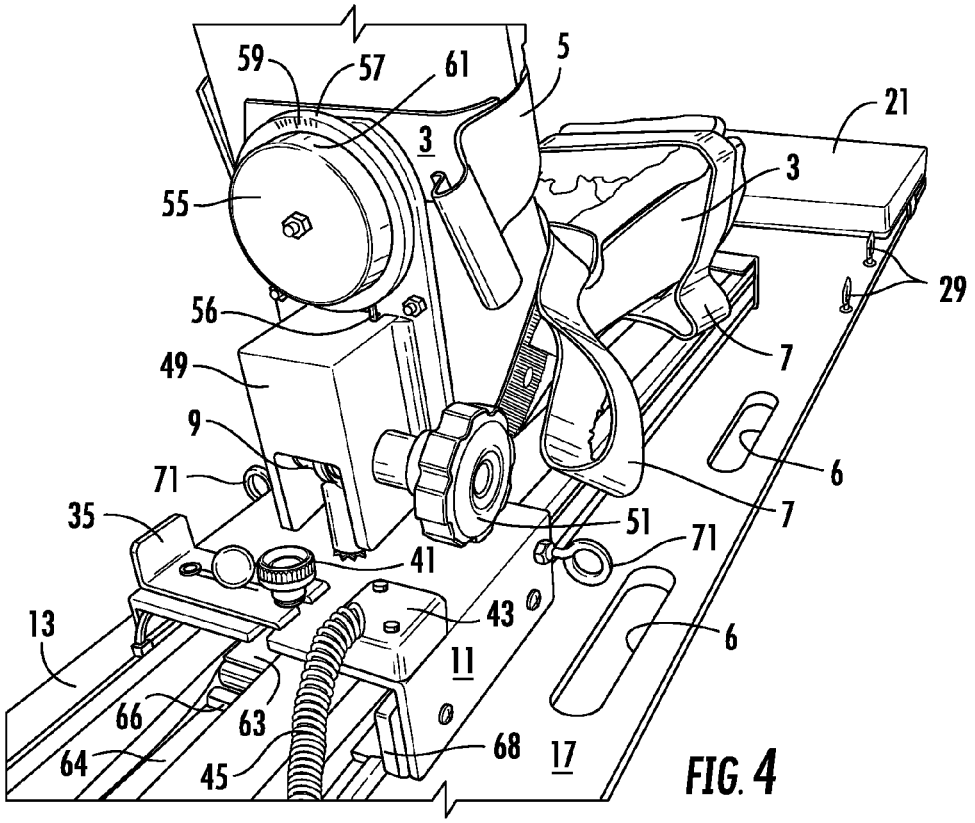
FIG. 4 is a partial perspective view of an orthosis machine according to an exemplary embodiment of the invention, including the area of the carriage, the proprioception joint, and the lower appendage cradle.
Figure 10:
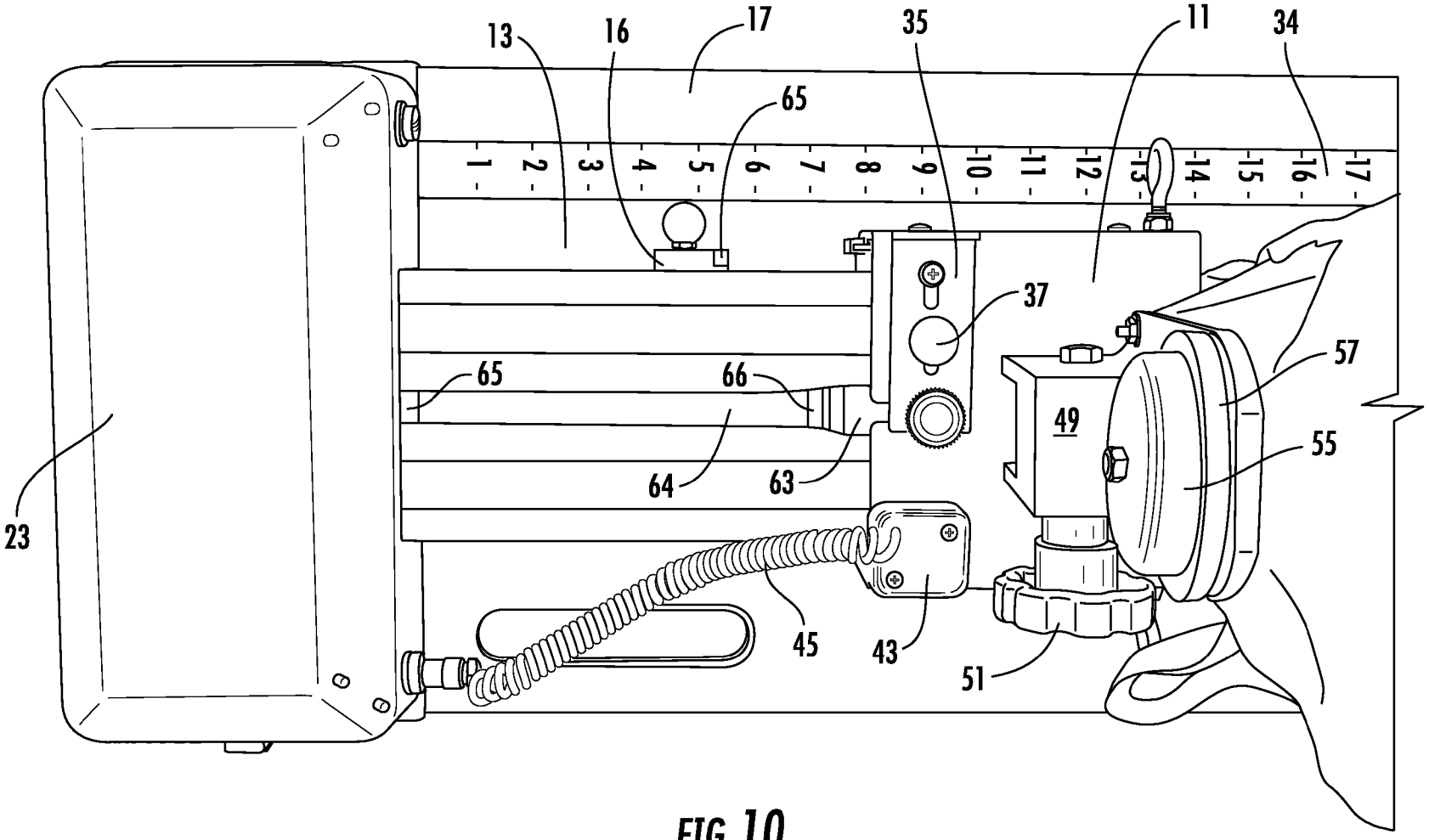
FIG. 10 is a partial perspective view of an orthosis machine according to an exemplary embodiment of the invention, viewed from above.
Figure 15:
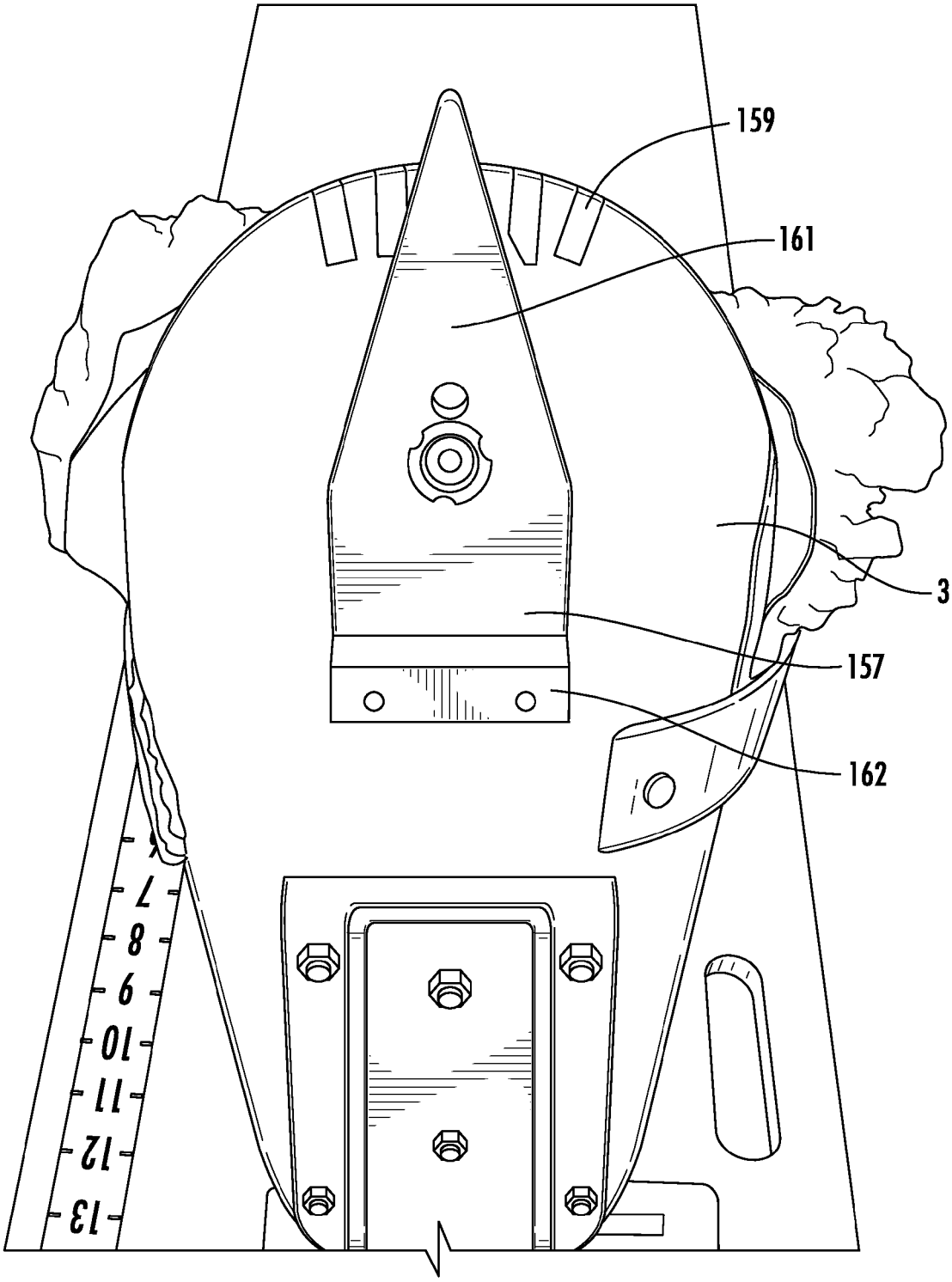
FIG. 15 illustrates a possible embodiment for a rotational position indicator.

FIGS. 4 and 10 show the lower appendage cradle 3 with the joint housing 49 mounted to the underside of the lower appendage cradle 3. A housing 55 may include a proprioception-related gauging such as, for example, a gravity-operable mercury switch (not shown) that may be rotatably mounted to the underside of the lower appendage cradle 3 within the housing 55. The mercury switch may communicate via a switch indication wire 56 to the communication port 43. A circular scale ring 57 may further be positioned between the housing 55 and the lower appendage cradle 3, and may have angle indicator markings 59 inscribed upon it. The housing 55 may have a rotational position marker 61 inscribed upon it. In other possible embodiments other types of rotational position markers may be used, a pointer for instance, as shown in FIG. 15 and discussed further hereinbelow.

FIG. 4 further shows a drive anchor 63 that may be connected to a drive belt 64. The drive anchor 63 may be fitted to screwably receive and secure the engaging knob 41 via attachment aperture 42 to allow the drive belt 64 to operate the lower appendage cradle 3. See FIGS. 10, 12. Further, drive anchor 63 and/or drive belt 64 may have a drive stop detector 66 mounted thereon and in communication with motor 83 via communication cord 45. One or more handles 6 may also be formed in the base 17.

Figure 5:
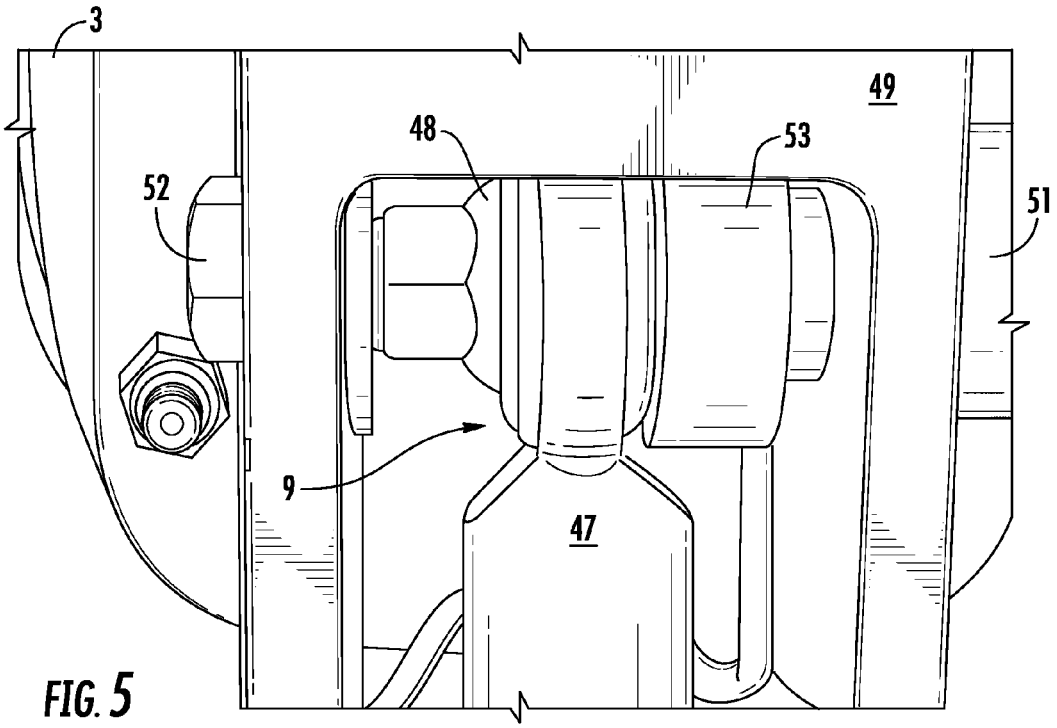
FIG. 5 is a partial perspective view of an orthosis machine according to an exemplary embodiment of the invention, showing a close-up of the proprioception joint.
Figure 6:
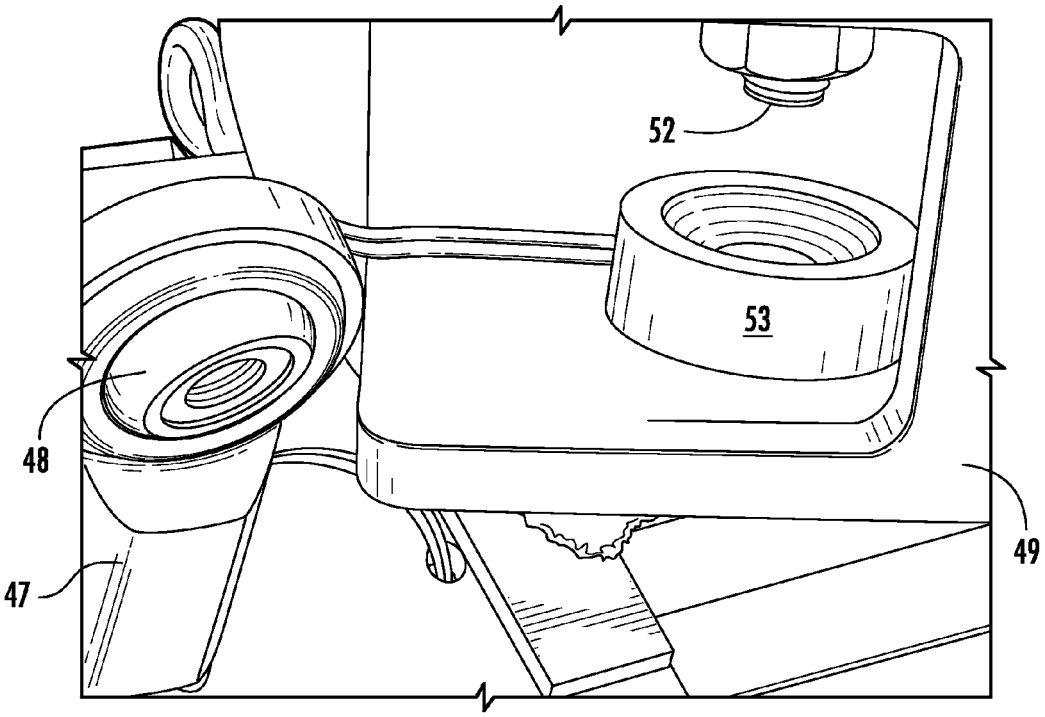
FIG. 6 is a partial perspective view illustrating a disassembled portion of the proprioception joint according to an exemplary embodiment of the invention.

FIG. 5 provide a close-up view of the rotational joint 9, including the joint shaft 47, ball 48, joint housing 49, bolt 52 and bushing 53. FIG. 6 shows a disassembled view to better see the configuration of the ball 48 within the joint shaft 47, and of the bushing 53 that may be secured in place on bolt 52 via tightening knob 51. Accordingly, bolt 52 may be in communication with one or more of tightening knob 52, bushing 53 and ball 48. In addition, one or more nut 46 may be positioned on a threaded bolt 42 to appropriately configure the desired spacial relationship between, for example, the bushing 53, ball 48, and tightening knob 52.

Figure 7:
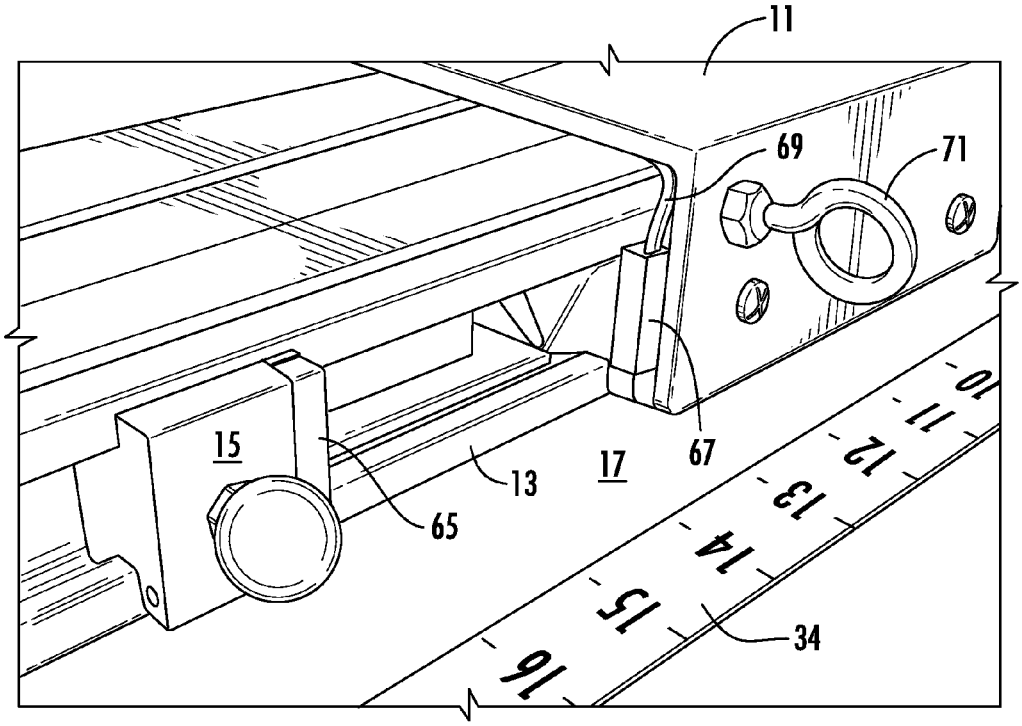
FIG. 7 is a partial perspective view of an orthosis machine according to an exemplary embodiment of the invention, showing the area of one of the stops and opposing stop detector on the carriage.
Figure 9:
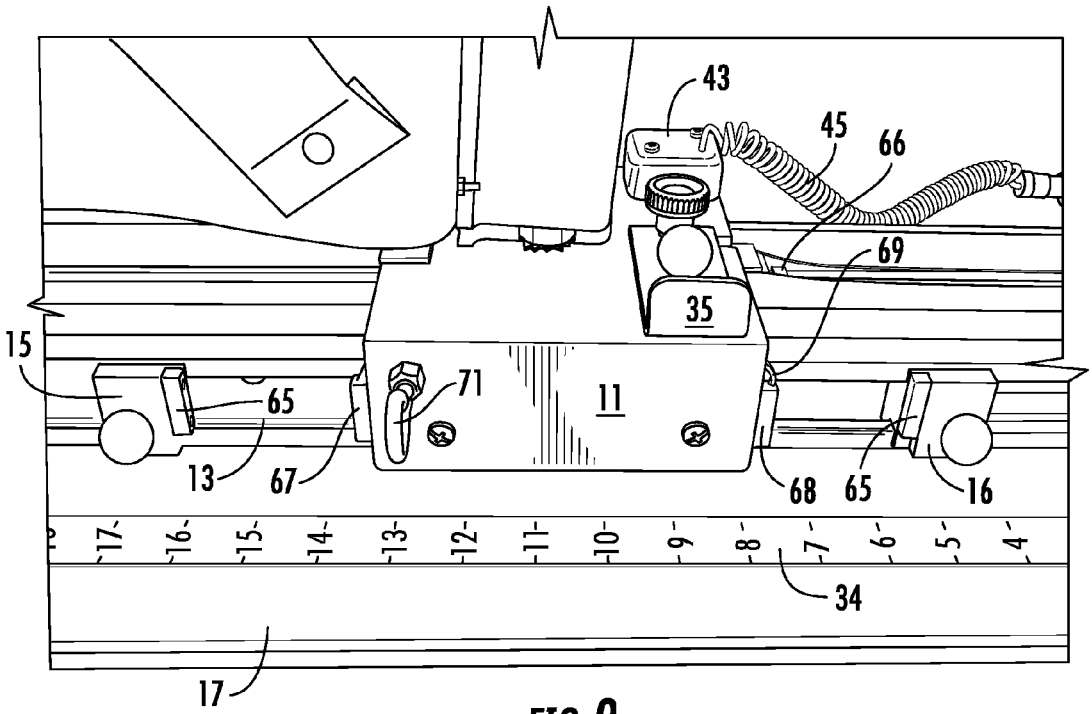
FIG. 9 is a partial perspective view of an orthosis machine according to an exemplary embodiment of the invention, showing portions of the invention including the area of the carriage, track, and stops.

With reference to FIGS. 7, 9, AND 10, the upper and lower stops 15, 16 may be slidably mounted to the track 13 and may be equipped on a side facing the carriage 11 with stop detectors 65. Stop detectors 65 may be electromagnetic, magnetic, RFID, or other sensing technology. Upper and lower stop detectors 67, 68 may be mounted to either end of one or both sides of the carriage 11 opposite a respective stop detector 65. Alternatively, upper and lower stop detectors 67, 68 may be able to sense stop 15 via infrared or other sensing technology without stop detector 65 as shown in the illustrated embodiment. Further, stop detectors 65 may be able to sense the carriage 11 approaching and affect the position of carriage 11. A stop indication wire 69 may extend under the carriage 11 to connect the stop detectors 67, 68 with the communication port 43.

As shown in FIGS. 7 and 9, the positioning gauge 34 may be placed substantially parallel and close to the portion of the track 13 upon which the stops 15, 16 slide, to better gauge the positions of the stops 15, 16 and/or the stop detectors 65 or stop detectors 67. Attachment portions 71 may be mounted to one or more sides of the carriage 11 for securing straps 72, that may be resistance straps, and/or non-yielding straps with grips 129, as described hereinafter (see FIGS. 14, 16, and 17).

Figure 8:
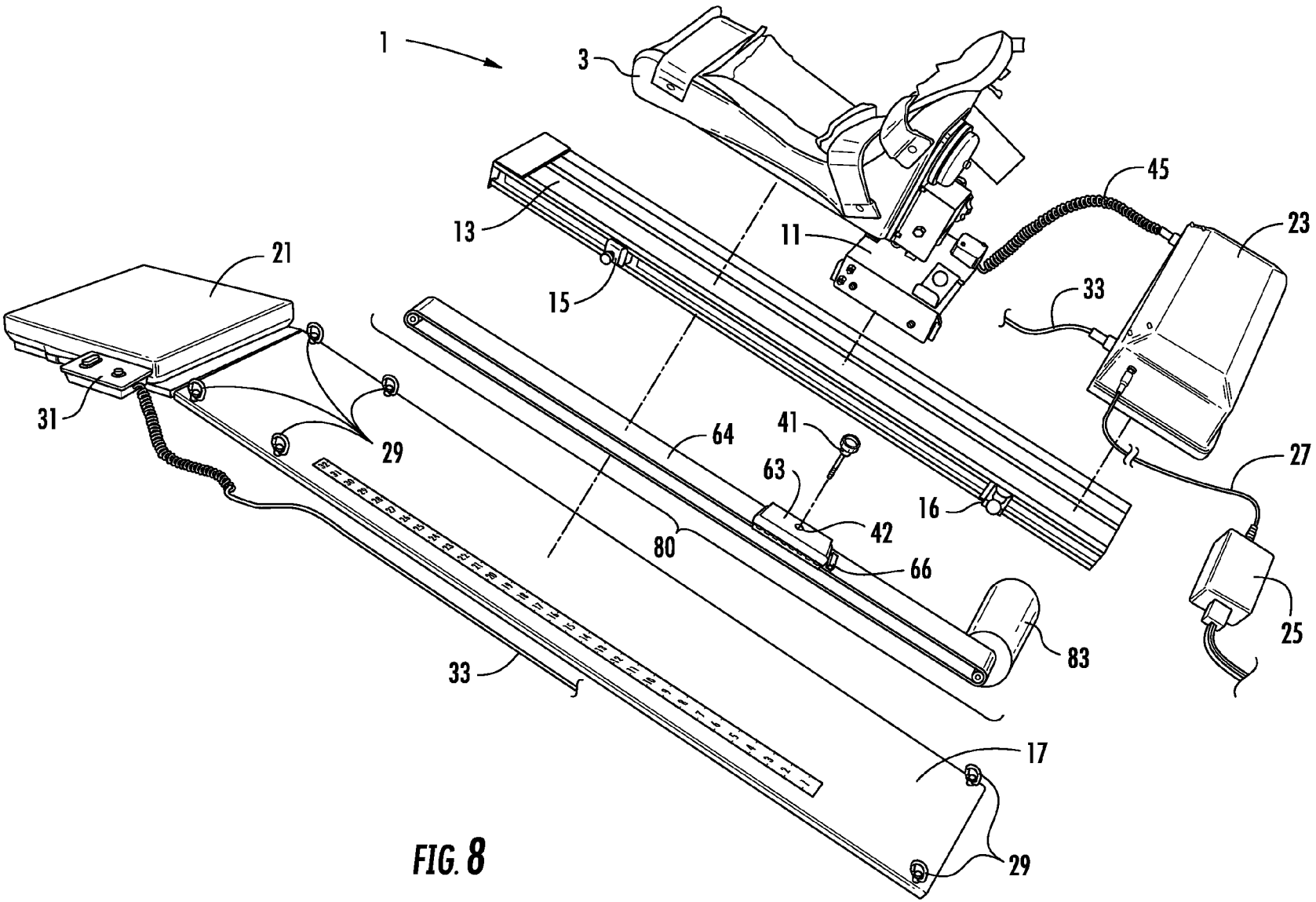
FIG. 8 is an exploded perspective view of portions of an orthosis machine according to an exemplary embodiment of the invention.

FIG. 8 illustrates the exploded view of the orthosis machine 1, wherein the lower appendage cradle 3 may be rotationally secured to the carriage 11. The carriage 11, and/or components thereof/thereon, may be in communication with the motor 83 within motor housing 23 via communication cord 45. Further, power supply 25 may also be in communication with the motor 83 within the motor housing 23 via power cord 27. The carriage 11 may also be slidably mounted to the track 13. The carriage 11 may also be detachably connectable to a drive train 80 for movement along track 13. As can be seen in FIG. 8, the drive train may include belt 64, drive anchor 63, engaging knob 4 and/or motor 83. Further, drive train 80 may be controlled by a user via remote control unit 31 in communication with motor 83 by way of, for example, control cord 33. Engaging knob 41 may be adjustably or fixedly attached to drive anchor 63 via attachment aperture 42. The track 13 may be mounted to the base 17.

Alternatively, as can been in the figures, wireless communication between motor 83 and remote control unit 31 and/or between motor 83 and/or stops/sensors 65, 66, 67, 68 can be employed according to the present invention. Further, in embodiments where the motor 83 is disengaged or otherwise not included in the embodiment at all, communication between one or more stops/sensors 65, 66, 67, 68 and the biofeedback functions may be accomplished via communication cord 45 and/or wirelessly.

Figure 11A:
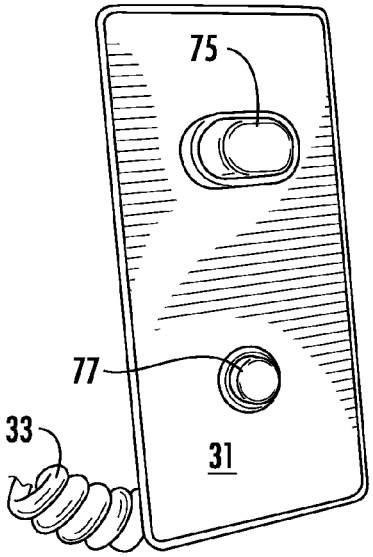
FIG. 11A shows a remote control unit in an orthosis machine according to an exemplary embodiment of the invention.
Figure 11B:
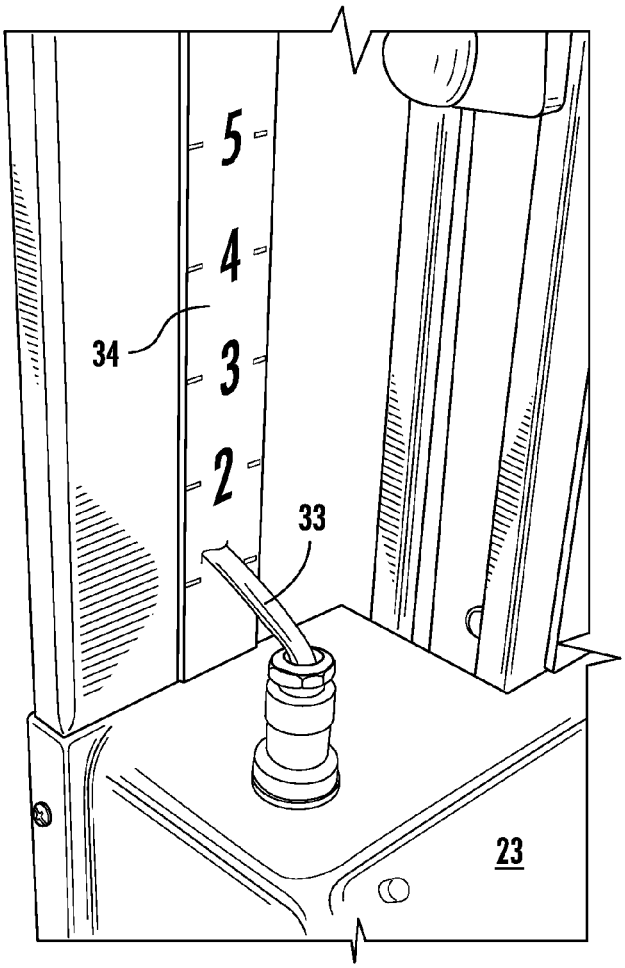
FIG. 11B is a partial perspective view of an orthosis machine according to an exemplary embodiment of the invention, illustrating a possible configuration for connecting the control cord with the motor compartment.

FIGS. 11A and 11B illustrate the remote control unit 31 that may include an on-off switch 75 and a motion reversing button 77. The control cord 33 may communicatively connect the remote control unit 31 with the circuitry inside the motor compartment 23.

Figure 12:
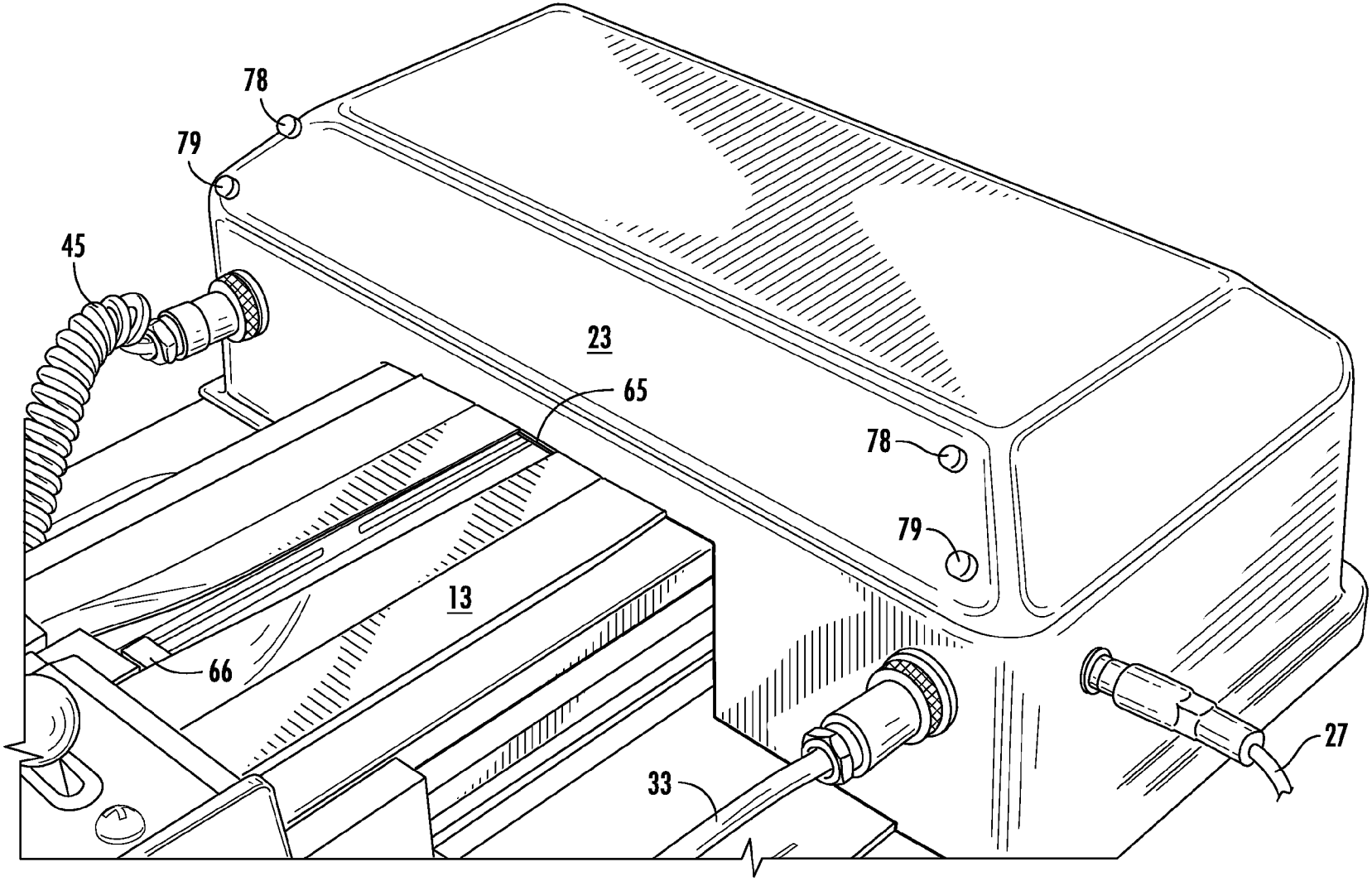
FIG. 12 is a partial perspective view of an orthosis machine according to an exemplary embodiment of the invention, showing the area of the motor compartment.

With reference to FIG. 12, LEDs or other lights of different colors such as, for example, green LEDs 78 and red LEDs 79 may be positioned on either side or both sides of the motor compartment 23. Other colored LEDs 78, 79 and/or indicators may be used within the spirit and scope of the present invention.

Figure 13:
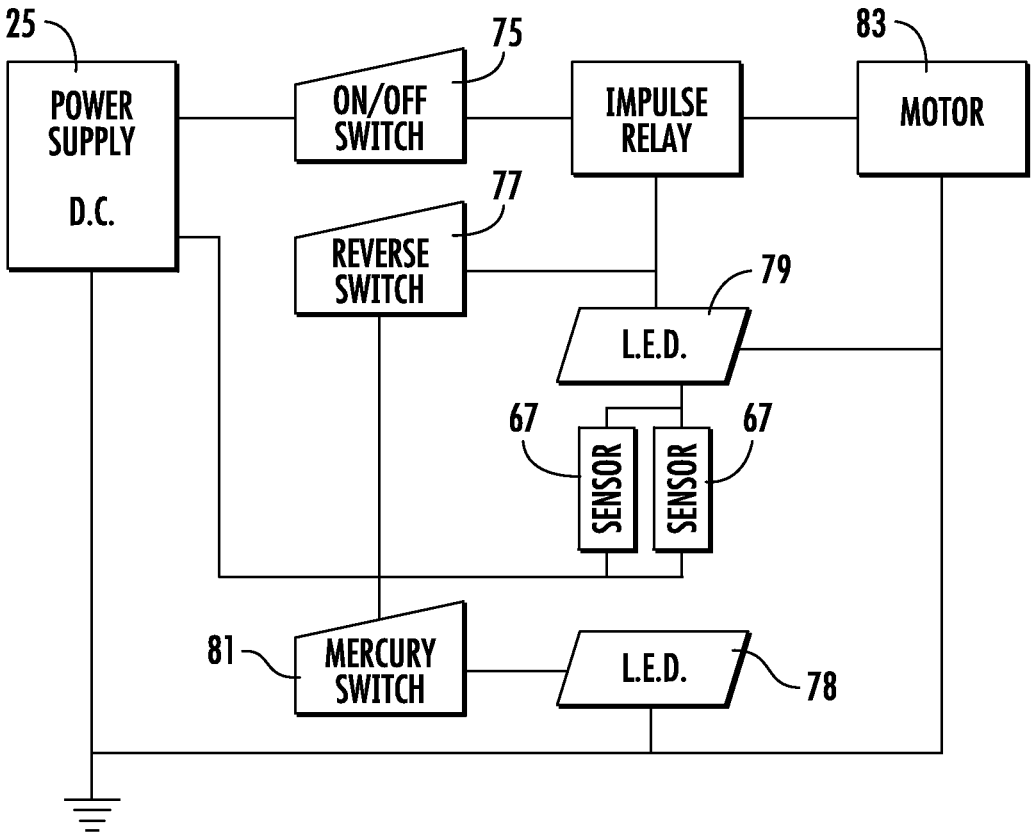
FIG. 13 illustrates an electronic circuit schematic showing the power supply and motor section of an orthosis machine according to an exemplary embodiment of the invention.

FIG. 13 depicts the circuitry of an embodiment of the invention that may be powered by a remote 24 V DC power supply 25, and driven by a 24 V DC reversible motor 83. Other components may include the on-off switch 75 and the motion reversing button 77, LEDs 78, 79, sensors (e.g., the stop detectors) 67, 68, and a mercury switch 81 housed within the housing 55. While in the illustrated exemplary embodiment the power supply 25 may be a direct current (DC) power supply that receives power from an alternating current (AC) power supply such as an electric outlet (not shown) and the power cord 27 may removably plug into circuitry within the motor compartment 23. In other possible embodiments different power source types may be used such as, for example, battery power, and the connection could be made non-removable. Further, other circuitry may be employed in accomplishing the beneficial functionality as outlined in more detail below including circuitry implementing biofeedback functionality only.

Functional Utilization

Figure 2:
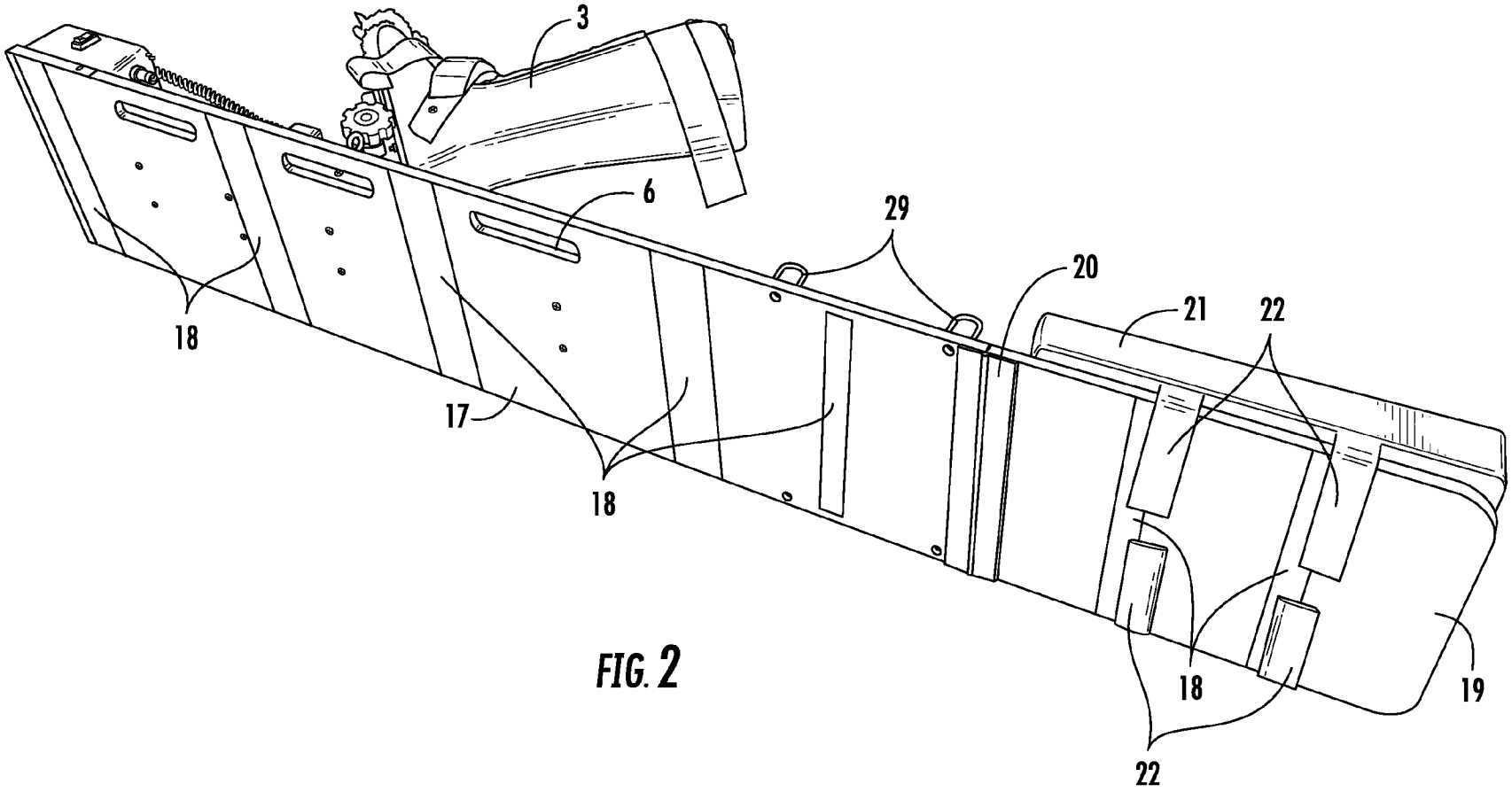
FIG. 2 is a perspective view of an orthosis machine according to an exemplary embodiment of the invention, viewed from below.

In an exemplary embodiment of the invention, as shown in the figures in basic operation, the upper baseplate 19 may be hinged 20 to enhance the portability of the device and may further make it easier to move or ship. The hinge of upper baseplate 19 also may permit the exemplary embodiment to be used in a variety of positions, so that the patient may be able to perform most or all of the therapy from a seated, supine, or recumbent position. For example, the upper baseplate 19 could be placed on a chair and the patient could sit on the seat pad 21. As shown in FIG. 2, for example, a full-length hinge may be employed to allow the hinged upper baseplate 19 to move as much as 180° in a downward direction so that it folds back against the base 17. The upper baseplate 19 could be also parallel with the base 17 forming a flat surface for use when the patient is recumbent.

In an exemplary embodiment, a user may position stops 15 by sliding one or more of them along the track 13 and secure them in place. Accordingly stops 15 may then define the motion range of the carriage 11 and lower appendage cradle 3, as may be recommended by a physician or physical therapist. The user may then position themselves on the seat cushion 21 and place their lower leg within the lower appendage cradle 3. The user's lower leg may then be secured by one or more foot straps 7 and/or one or more shin straps 5, wherein the user's foot may rest upon the optional supportive cushion 8 positioned within the lower appendage cradle 3.

The user may then operate the orthosis machine 1 by picking up the remote control unit 31. When the on-off switch 75 is turned on, power is supplied from the power supply 25 to the motor 83 within the motor compartment 23 via the power cord 27. When the power is supplied to the motor 83, the carriage 11 may move along the track 13 via drive belt 64 carrying the attached lower appendage cradle 3 with it and thereby moving the patient's foot and providing therapy for the patient's joint being treated. When the carriage 11 moves far enough so that at least one of the stop detectors 67, 68 on either side of the carriage 11 comes into contact and/or close proximity with the stop detector 65 of the stop 15 on that side of the carriage 11, a signal may pass through the stop indication wire 69 to the communication port 43. From communication port 43, the signal may then pass through the communication cord 45 to the circuitry in the motor compartment 23 to cause the drive belt 64 to reverse direction. Accordingly, while the carriage 11 is engaged by way of drive anchor 63 to the drive belt 64, the lower appendage cradle 3, and thus the patient's foot, will reverse direction as the drive belt 64 reverses direction.

Figure 14:
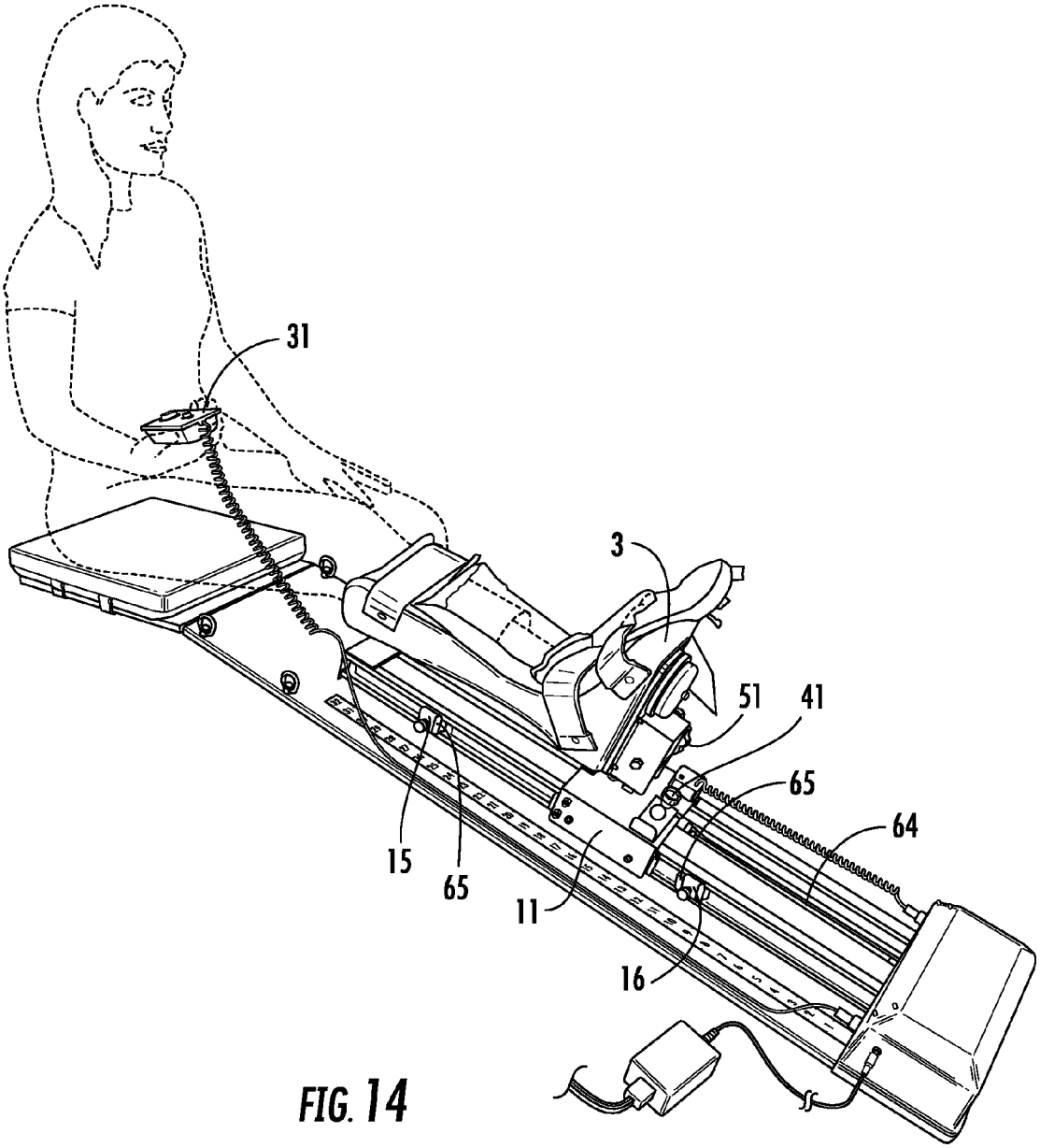
FIG. 14 is a perspective view illustrating user-controlled selectively motorized use of an orthosis machine from a seated position according to an exemplary embodiment of the invention.

FIG. 14 shows a patient (shown in shadow) using the device with manual control. In this figure the user is shown in a sitting position and holding the remote control unit 31. In this configuration the carriage 11 (and accordingly the lower appendage cradle 3 due to engagement with belt 64 via engaging knob 41) will be moved by operation of the motor 83 between the desired positions dictated by the selected positions of the upper stop 15 and the lower stop 16. With reference to FIG. 11A, with the remote control unit 31 the user may manually control the motor 83 on and off with the on-off switch 75 and reverse direction of the carriage with the motion reversing button 77. With the range of motion shown in FIG. 1, for example, with the tightening knob 51 secured, the lower appendage cradle 3 may rotate about at least one vertical axis running the length of the track 13. The tightening knob 51 may also be loosened so that the lower appendage cradle 3 will be able to rotate more freely, allowing the user to bend the knee while being able to rotate the ankle with greater range of motion about the rotational joint 9. The upper stop 15 and the lower stop 16 could be positioned closer together for a smaller range of motion in order to provide limited flexion-bending of the joint area for controlled bending the of knee. In addition, the upper and lower stops 15, 16 may be configured to be selectively positioned along track 13 so as to not be able to be overcome by the driving force of the motor 83 in the event stops 65, 67, 68 might fail.

Additionally, a biofeedback indicator function may be provided by this feature by alerting the user when the carriage is in a certain position or positions. Biofeedback allows a user to set goals for range of motion with feedback (e.g. light, audible, tactile, etc.) when the goal is met such as with bending or straightening. Accordingly, as the carriage 11 may approach one or more of the stops 15, 16, an electronic signal may be sent and one or more of the LEDs 78, 79 may be lit, for example the red LEDs 79, thereby alerting the user that a motion goal has been met, or that a change of direction should be made. In other possible embodiments an audible or even tactile signal could be used in place of, or in addition to, the LEDs or other light as shown in FIG. 13. The stopping point of the carriage 11 may be stationary in some embodiments, or in other embodiments may be made adjustable by manipulating the position of the stops 15. Or, as explained above, the stops 15 may also be used to change the direction of the carriage 11 automatically. Other modes of biofeedback using varied modes for providing light, audible or vibration indications to a user may be implemented in accordance with the spirit and scope of the invention.

Unlike conventional CPM machines, which generally do not provide proprioception or biofeedback training mechanisms, passive knee extension and/or operate from a seated position, embodiments of the orthosis machine 1 disclosed herein, like the exemplary embodiment(s) illustrated in the drawing figures, allow such training to take place.

With reference to FIGS. 3-5, when proprioception training is desired, the tightening knob 51 may be manipulated to allow the ball 48 to rotate within the joint 47 by permitting the bushing 53 to loosen from engagement with the joint 47. When the proprioception training is not desired, the tightening knob 51 is generally manipulated to push the bushing 53 against the joint 47, which straightens joint housing 49 and thus the lower appendage cradle 3 with respect to the carriage 11, keeping the user's foot aligned with the track 13 and preventing side-to-side motion. But when the tightening knob 51 is manipulated to loosen the ball 48, the lower appendage cradle is permitted to swivel within the joint 47 socket, allowing side-to-side motion during use by the user.

FIGS. 5 and 6 help to illustrate how this is accomplished. In particular, FIG. 6 gives a disassembled view showing the internal structure of the assembly comprising the joint shaft 47, the ball 48, and the bushing 53. From these figures it can be seen how when the tightening knob 51 is tightened the flat side of the bushing 53 is pushed securely against the opposing flat side of the joint shaft 47, thus keeping the joint shaft 47 rigid in its position. But when the tightening knob 51 is loosened the flat side of the bushing 53 is pulled away somewhat from the opposing flat side of the joint shaft 47, which allows the joint shaft 47, via the ball 48 within it, to rotate and move within a sculpted recess within the bushing 53. Accordingly, in the illustrated exemplary embodiment, such loosening of the busing 53 from the joint 47 may allow the patient's lower leg and foot to pivot left or right (i.e., about the axial plane of the patient's lower leg).

Further, by operation of the tightening knob 51 to release the lower appendage cradle 3 from a secured position, the patient's foot may be permitted to rotate up and down toward the motor housing 23. As used herein, the term "rotatively attached" refers to allowing this side-to-side motion, up/down pivoting, and/or left/right rotation of the lower appendage cradle 3 to be performed by the patient.

Thus it can be seen that the exemplary embodiment illustrated herein that the orthosis machine 1 of the present invention allows side-to-side as well as front-to-back motion of the lower leg and foot of the patient, thereby providing the possibility of movement in multiple planes simultaneously. This allows proprioception training to occur during use of the orthosis machine 1 when the tightening knob 51 is loosened. Accordingly, the purposely created instability created by the joint 47 and ball 48, allows simultaneous multiple-plane movement allowing patients to engage their neurological proprioception receptors in an effort to stabilize one or more joints. Further, the rotational joint 9 can be adjusted, via the tightening knob 51 for example, to allow more or less movement to occur giving the patient control of range of rotation the joint and limb may undergo during therapy and/or training.

This proprioception training may occur during all phases of the therapy: passive range of motion, active assistive range of motion, active range of motion, and resistive range of motion thus better allowing the patient to learn to control the muscular functions of the joint for which therapy is being provided. Accordingly, the orthosis machine 1 may allow the patient to train and enhance proprioception in the joint, and/or work on strengthening the knee and surrounding muscles, should that be necessary, as the tightening knob 51 can be either loosened or tightened as described herein so that the therapy can be performed either with or without proprioception during any of the phases.

With regards to providing a patient with more specific goals to achieve desired outcomes, the proprioception function may be used to allow the patient to practice keeping his foot at a certain desired angle. Such functionality may be accomplished by employing one or more mercury switches 81, which may be positioned within the housing 55. As may be prescribed or suggested for therapy, the patient may be instructed as to the length of time and rotational goals of the lower appendage cradle that may be further established by the rotation of the rotational position marker 61. Accordingly, when the rotational position marker 61 is set by the patient to a setting indicated on the circular scale ring 57 and the lower appendage cradle 3 is rotated to the left or the right by the patient to match that setting, the one or more mercury switches 81 may send a signal to the LEDs 78, 79 via the switch indication wire 56 to alert the patient that they have reached the indication angle set on the circular scale ring 57. Thus, when the patient's leg and foot is held in place at the correct angle, the one or more mercury switches 81 may send an indication via the switch indication wire 56, communication port 43, and communication cord 45, to light one or more of the LEDs on the motor compartment 23, for example the green LEDs 78, thereby providing biofeedback indication to the patient that the foot/leg is being held in the correct position. Having LEDs 78, 79 on either sides of the motor compartment 23 can be beneficial in case the position of the foot, at whatever angle it is being held, obscures one or more of the LEDs 78, 79 on one side.

In the illustrated exemplary embodiment, the proprioception functionality may be attached to the lower appendage cradle 3 as a rotational gauge type mechanism with incremental markings on the circular scale ring 57 that are utilized to set targets or markers for the patient to attempt to control motion, as described above. However, various other types of motion control means can be used as well as described herein.

Other embodiments may include, as illustrated in FIG. 15 for instance, an angular gauge assembly 157 rotatably attached to the lower appendage cradle 3, for example (as shown in FIG. 6) on the underside of the lower appendage cradle 3. The angular gauge assembly 157 may include a pointer 161 and a plumb weight 162, with the pointer 161 projecting toward an angular scale 159 on the lower appendage cradle 3 that indicates the rotational angle achieved by the rotation of the foot by the user. Pointer 161 may be configured to be various shapes and/or opaque, translucent or otherwise illuminated such that the patient may adequately observe where the pointer is directed based upon the articulation of the patient leg. Such scale 159 provides a target for alignment of the user during proprioception related use of the orthosis machine 1. The plumb weight 162 will normally be positioned toward the bottom of the positioning gauge assembly 157 so that gravity will cause the pointer 161 to rotate relative to the angular scale 159 as the lower appendage cradle 3 is rotated. Both the pointer 161 and the angular scale 159 may preferably be visible from both sides of the bottom of the lower appendage cradle 3, so that both the patient and an assistant on the other side of the device may visualize where on the angular scale 159 the pointer 161 is pointing.

Unlike conventional CPM machines, various phases of therapy may be accomplished with embodiments of the orthosis machine 1 of the present invention described herein. For example, for the passive motion phase the apparatus may be used in the basic mode described above, with the carriage 11 moved automatically up and down along the track 13 over a prescribed range as set by the stops 15, 16 and operational by the remote control unit 31. The leg may further be held down into a straightened or extended position by the restraining pads 73 secured either with elastic resistance straps 72, or non-yielding straps 72, to attachment portions 29. Thus, passive knee extension can be facilitated between flexion training sessions to permit the leg to be pushed into extension or straightened.

Active Range of Motion (AROM) may be performed with this device, such that the patient may be enable to use his/her volitional muscle contractions to move the carriage with the desired range of travel on the track 13. The carriage 3 may thus assist in stabilizing the patient's hip, leg, knee and/or ankle as the surrounding muscles are strengthened and/or treated via the orthosis machine 1. AROM may thus be performed, for example, with the power turned off, the engaging knob 41 and/or slide screw 37 loosened, and the engaging plate 35 slid back from the engaging knob 41. Thus, the carriage 11 may be operated by the patient along the track 13 without being restricted by the drive belt 64 engaged with the powered off motor 83. Further, in accordance with the present invention, in the event the patient does turn on the motor 83 while the carriage 11 is disconnected, one or more stop detectors 65 may be positioned to engage at least one drive stop detector 66 to prevent damage to the orthosis machine 1. Accordingly, at least one stop detector 65 may prevent over rotation of the belt 64 clockwise while another stop detector 65 may prevent over rotation of the belt 64 counterclockwise.

Figure 16:
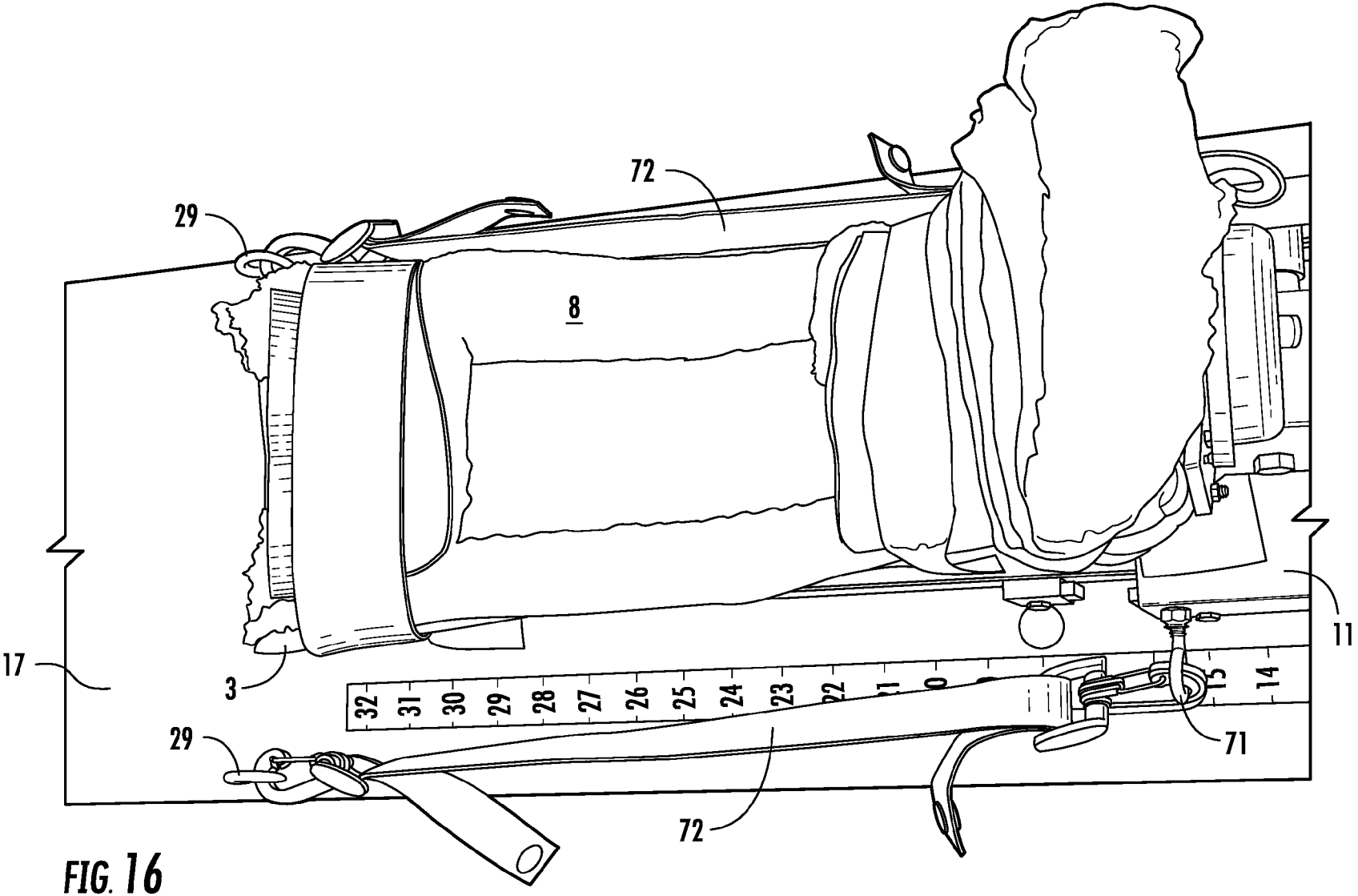
FIG. 16 is a partial perspective view, including the lower appendage cradle and straps, of an orthosis machine according to an exemplary embodiment of the invention.

As can be seen in FIG. 16, various straps 72 may be implemented to provide for Resistive Range of Motion (RROM). Accordingly, straps 72 made permanently mounted or detachable from attachments 29, 71 for convenience while using the orthosis machine 1 in various modes. Straps 72 may be elastic, adjustable, interchangeable, vary in thickness and/or length to provide desired resistance. Accordingly, the force required to translate the carriage 11 up and/or down the track may be adjusted. In a preferred embodiment, the carriage 11 may be released from the drive belt 64 by disengaging knob 41, while the remote control unit 31 and the control cord 33 are optionally detached and removed from the motor compartment 23, to enable the patient to move the carriage 11 up and down the track 13 against the force of the straps 72. For further ease of use, the power cord 27 may also be detached and removed from the motor compartment 23 as well to avoid possible entanglements with the straps 72.

Various other ways of providing resistance during resisted range of motion (RROM)/strengthening phases of therapy using exemplary embodiments of the orthosis machine 1 of the present invention are also possible. For instance, resistance straps 72 may secure the restraining pads 73 to the attachments 29 to provide resistance against the leg while bending the knee, and to provide resistance while pulling the foot toward the body. Conversely, additional and/or other resistance straps 72 can be connected between one or more attachments 29 mounted to the base 17 and one or more attachments 71 mounted to the carriage 3, to provide varied desired resistance while the patient pushes the foot away from the body as described above. In addition, proprioception training may be accomplished in this phase, as well as others, by disengaging knob 51 to a desired range of motion.

Figure 17:
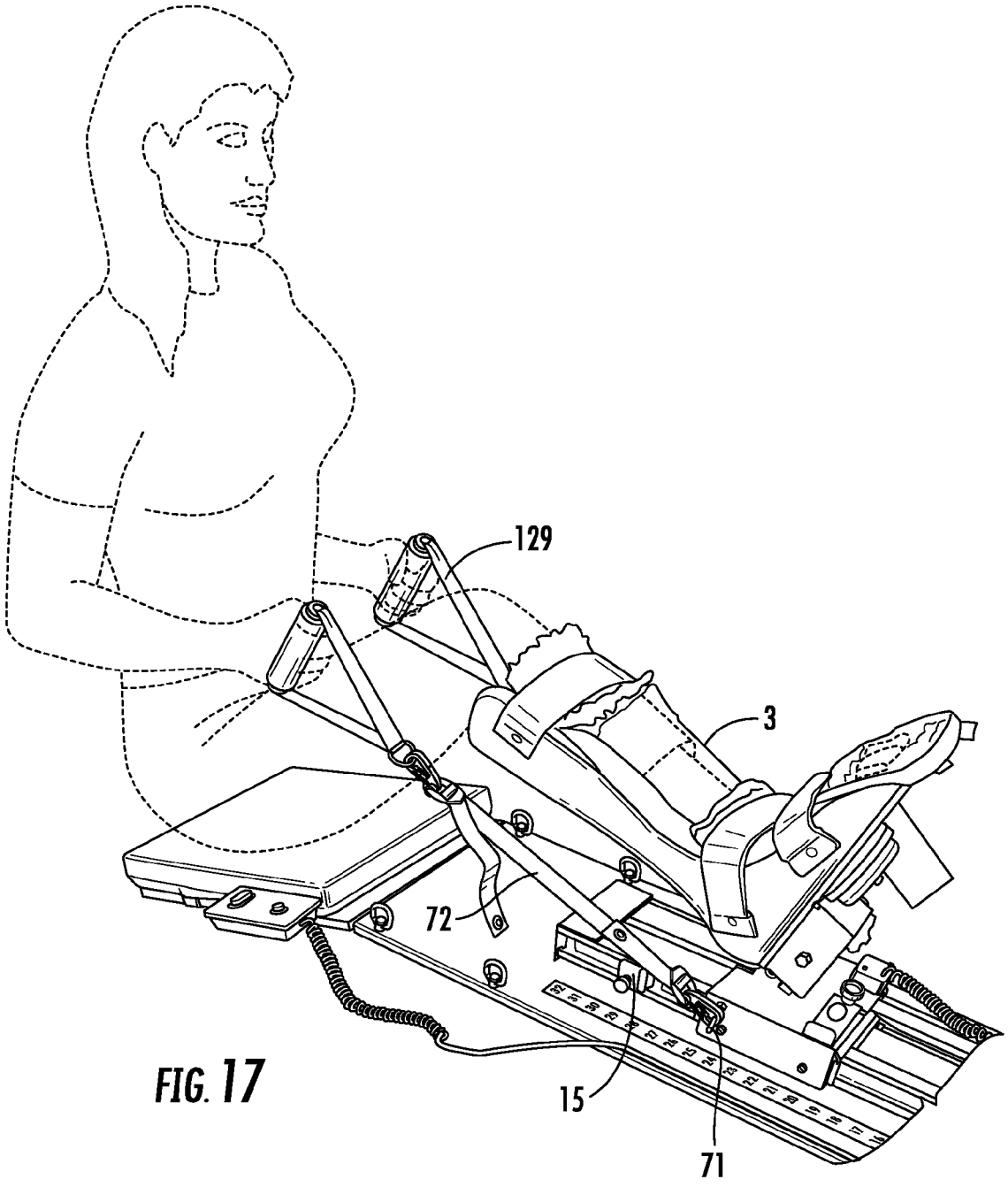
FIG. 17 is a partial perspective view illustrating the lower appendage cradle and straps with grips of an orthosis machine being employed in a seated position according to an exemplary embodiment of the invention.

FIG. 17 illustrates another possible configuration, wherein straps 72 may be connected between grips 129 and the attachments 71 of the carriage 11, giving the patient physical control over the travel of the foot in the cradle 3 along the track 13 for accomplishing the Active Assisted Range of Motion (AAROM) phase. AAROM may thus be performed with the orthosis machine 1, through the patient manually self guiding the effort along and thus assisting the joint in a predictable path with the motor 83 preferably disengaged. Accordingly, AAROM phase treatment may allow the patient to manually assist and thus guide the limits of the range of motion to both directions. In some cases, extending beyond the end range may be encouraged to gain more motion as part of the rehabilitative process that may be guided by the patient supporting the cradle 3 via grips 129 and straps 72. Stops 15, 16 may also be positioned as a fail-safe in the event the patient looses grip or strength to actively assist in controlling the range of motion.

Figure 18:
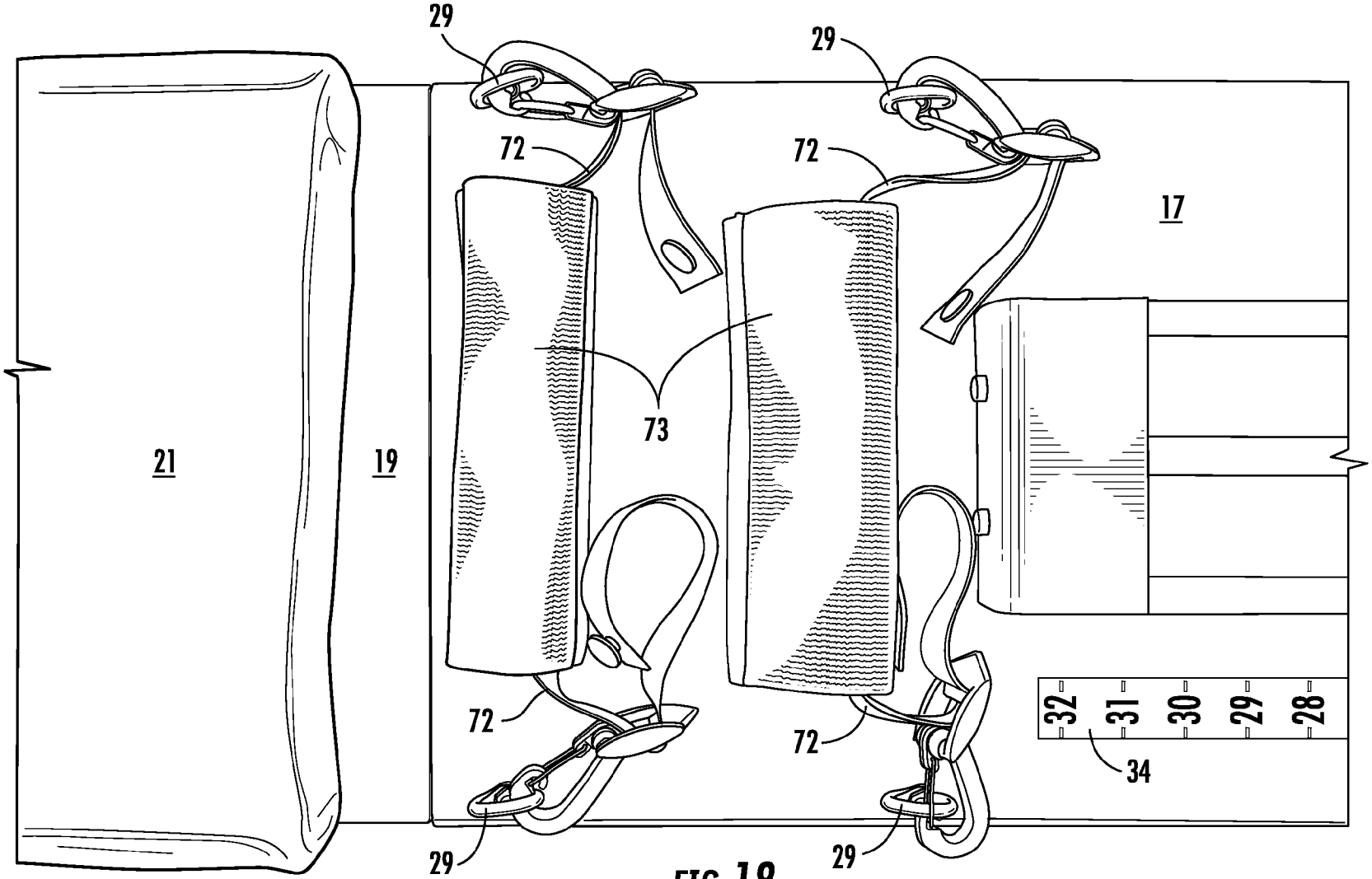
FIG. 18 is a partial perspective view of an orthosis machine according to an exemplary embodiment of the invention, showing restraining/resistance straps and pads.

FIG. 18 illustrates another possible configuration, wherein, restraining pads 73 may be secured by resistance straps 72 to the attachments 29 at a position near seat pad 21. In this configuration, resistance could be provided by providing resistance against the patient's thigh rising during bending of the joint. Accordingly, at least a three point pressure system may be provided with the present invention to encourage the patient's leg to straighten. These points of pressure may include the heel area, below the kneecap and the thigh. Such treatment is often necessary following knee surgery to regain full range of motion. This configuration may allow the patient to apply pressure into extension while having the leg being biased to straighten by restraining pads 73 and resistance straps 72. Accordingly, straps 72 of varying pressure grades based on the amount of resistance needed can be used to push the knee straight.

With reference to FIG. 13, the circuitry of an illustrated exemplary embodiment allows for several different functions. With reference to FIG. 11A, the handheld component circuitry allows for a safety-reverse system in which the patient may reverse the motion of the carriage by pushing the motion reversing button 77 and may stop the motion by operating the on-off switch 75. The on/off-switch 75 controls power to the motor 83 which drives the drive belt 64 to move the carriage 11. The circuitry may also control the function of the stops 15, stop detectors 65, and stop detectors 67, 68 that affect the proprioception and/or biofeedback indicator function, as described above.

For example, with further reference to FIG. 13, an embodiment of the invention may be powered by a remote 24 V DC power supply 25, and driven by a 24 V DC reversible motor 83. Other components may include the on-off switch 75 and the motion reversing button 77, LEDs 78, 79, sensors (e.g., the stop detectors) 67, and a mercury switch 81 housed within the housing 55. While in the illustrated exemplary embodiment the power supply 25 may be a direct current (DC) power supply that receives power from an alternating current (AC) power supply such as an electric outlet (not shown) and the power cord 27 may removably plug into circuitry within the motor compartment 23, in other possible embodiments different power source types may be used, and the connection could be made non-removable. Further, other circuitry may be employed in accomplishing the beneficial functionality.

Feedback may be provided to the user when the carriage 11 reaches its set range of motion limit via one or more LEDs 78, 79. When the electromagnetic switch/sensor receives a signal, it may be sent to one or more LEDs 78, 79 giving the user biofeedback that the goal has been reached for flexion or extension. The proprioceptive mechanism may use a mercury switch to light one or more LEDs 78, 79 when the user centers the foot piece to a desired positional attitude. One or more LEDs 78, 79 stay illuminated as long as the foot is being held on target as the carriage 11 moves through the range of motion.

As can be seen from the above description, any CPM device utilizing the invention may allow a patient to progress through various phases of the rehabilitation process following an injury or surgical intervention, to a knee or hip joint, for example. Combining one or more of these functions in the same machine will reduce medical cost to the insurer and patient as well as providing consolidation of the various phases of rehabilitation to speed recovery. For example, a patient who has had knee surgery can perform passive range of motion (PROM) early during the recovery process, then progress to active assistive range of motion (AAROM) exercise, thereafter to active range of motion (AROM) exercise, and finally to resistive range of motion (RROM) exercises wherein all of these may be performed from a seated position with proprioception and biofeedback features. Such enabled positioning of the patient may further increase compliance and improve outcomes. In addition, the present invention may exclude features such as the PROM treatment capabilities by removing the power train 80 and features and functions associated therewith such that AAROM, AROM and RROM are the primary features of the orthosis machine 1. Accordingly, the patient would provide all the necessary travel force to translate up and down the track 13 in the cradle 3 therein requiring less power than the PROM/drive train functionalities of the invention.

Although the invention has been described in detail for the purpose of illustration based on what is currently considered to be the most practical and preferred exemplary embodiment(s), it is to be understood that such detail is solely for that purpose and that the invention is not limited to the particular means and structure of the disclosed embodiments, but, on the contrary, is intended to cover modifications and equivalent arrangements that are within the spirit and scope of the appended claims. It is to be understood that the present invention contemplates that, to the extent possible, one or more features of any embodiment can be combined with one or more features of any other embodiment. For example, other types of drive trains may be employed beside or in addition to a belt drive such as, for example, a screw drive, rack and pinion, etc. Further, instead of the particular lower appendage cradle of the illustrated exemplary embodiment, a differently shaped cradle that can hold or secure any part of the foot and/or leg and/or hip, or arm, or other bodily appendage, may be used. Since other modifications and changes varied to fit particular operating requirements and environments will be apparent to those skilled in the art, the invention is not considered limited to the example chosen for purposes of disclosure, and covers all changes and modifications which do not constitute departures from the spirit and scope of this invention as set forth by the claims.

We claim:

1. An orthosis machine for facilitating motion of a user, comprising:

a base;

a track mounted to the base;

a carriage slidably mounted to the track;

a cradle adapted to hold a portion of a bodily appendage of the user; and a rotational joint configured to connect the cradle to the carriage, wherein the rotational joint is adjustable into a first configuration in which the rotational joint secures the cradle to the carriage such that the cradle is permitted to rotate with respect to the carriage in at least a first plane of rotation and is prevented from rotating with respect to the carriage in at least a second plane of rotation, and a second configuration in which the rotational joint secures the cradle to the carriage such that the cradle is permitted to rotate with respect to the carriage in at least the first plane of rotation and the second plane of rotation.

2. The orthosis machine of claim 1, further comprising: a drive train detachably connectable to the carriage and operable by a motor such that the drive train moves the carriage along the track when the drive train is connected to the carriage and the motor is operating.

3. The orthosis machine of claim 2, further comprising: a controller in communication with the drive train and operable by a user to select the motion in which the drive train moves the carriage along the track.

4. The orthosis machine of claim 1, wherein the base includes an upper baseplate rotatably connected to the base.

5. The orthosis machine of claim 1, further comprising:

at least one stop slidably connected to the track; and at least one stop detector mounted to the carriage.

6. The orthosis machine of claim 5, including an indicator operable to alert the user when the carriage is near at least one stop.

7. The orthosis machine of claim 2, further comprising:

at least one stop mounted to one portion of the drive train;

at least one stop detector mounted to another portion of the drive train; and electronic circuitry configured to reverse direction of the drive train when at least one stop detector comes into proximity of at least one stop.

8. The orthosis machine of claim 1, including an indicator operable to alert the user when the cradle is in a desired positional attitude.

9. The orthosis machine of claim 8, wherein the alert of the indicator provided is at least one of visual indicator, an audible sound, and a tactile disturbance.

10. The orthosis machine of claim 8, wherein sensors are positioned on the cradle to communicate with the indicator when the bodily appendage is in a desired positional attitude.

11. An orthosis machine for facilitating motion of a user, comprising:

a base;

a track mounted to the base;

a carriage slidably mounted to the track;

a cradle adapted to hold a portion of a bodily appendage of the user;

a drive train detachably connectable to the carriage and operable by a motor such that the drive train moves the carriage along the track when the drive train is connected to the carriage and the motor is operating;

at least one stop slidably connected to the track;

at least one stop detector mounted to the carriage, the at least one stop detector being configured to transmit a signal when the at least one stop detector comes into proximity with the at least one stop;

electronic circuitry in communication with the at least one stop detector and configured to reverse the direction of the drive train when the at least one stop detector comes into proximity with the at least one stop and transmits the signal; and an indicator in communication with the at least one stop detector and operable to alert the user when the at least one stop detector comes into proximity with the at least one stop and transmits the signal, wherein the carriage remains slidably mounted to the track and is movable along the track when the drive train is detached from the carriage.

12. The orthosis machine of claim 11, wherein the base includes an upper baseplate rotatably connected to the base.

13. The orthosis machine of claim 11, wherein the alert of the indicator provided is at least one of visual indicator, an audible sound, and a tactile disturbance.

14. The orthosis machine of claim 11, further comprising a rotational joint configured to connect the cradle to the carriage.

15. The orthosis machine of claim 14, including an indicator operable to alert the user when the cradle is in a desired positional attitude.

16. An orthosis machine for facilitating motion of a user, comprising:

a base;

a track mounted to the base;

a carriage slidably mounted to the track;

a cradle adapted to hold a portion of a bodily appendage of the user;

at least one stop slidably connected to the track;

at least one stop detector mounted to the carriage, the at least one stop detector being configured to transmit a signal when the at least one stop detector comes into proximity with the at least one stop;

an indicator in communication with the at least one stop detector and operable to alert the user when the at least one stop detector comes into proximity with the at least one stop and transmits the signal; and a drive train detachably connectable to the carriage and operable by a motor such that the drive train moves the carriage along the track when the drive train is connected to the carriage and the motor is operating, wherein the carriage remains slidably mounted to the track and is movable along the track when the drive train is detached from the carriage.

17. The orthosis machine of claim 16, wherein the base includes an upper baseplate rotatably connected to the base.

18. An orthosis machine for facilitating motion of a user, comprising:

a base having an upper baseplate rotatably connected to the base;

a track mounted to the base;

a carriage slidably mounted to the track;

a cradle adapted to hold a portion of a bodily appendage of the user; and a drive train detachably connectable to the carriage and operable by a motor such that the drive train moves the carriage along the track when the drive train is connected to the carriage and the motor is operating, wherein the carriage remains slidably mounted to the track and is movable along the track when the drive train is detached from the carriage.

19. An orthosis machine for facilitating motion of a user, comprising:

a base having at least one attachment portion mounted thereto;

a track mounted to the base;

a carriage slidably mounted to the track, the carriage having at least one attachment portion mounted thereto;

a cradle adapted to hold a portion of a bodily appendage of the user;

at least one strap secured to the at least one attachment portion mounted to the base; and a drive train detachably connectable to the carriage and operable by a motor such that the drive train moves the carriage along the track when the drive train is connected to the carriage and the motor is operating, wherein the carriage remains slidably mounted to the track and is movable along the track when the drive train is detached from the carriage.

20. The orthosis machine of claim 19, wherein the at least one attachment portion mounted to the base comprises at least two attachment portions mounted to the base and the at least one strap is secured to the at least two attachment portions mounted to the base.

* * * * *